US007159971B2

(12) United States Patent
Koike et al.

(10) Patent No.: US 7,159,971 B2
(45) Date of Patent: Jan. 9, 2007

(54) MULTI-NOZZLE INK JET HEAD

(75) Inventors: Shuji Koike, Setagaya (JP); Yoshiaki Sakamoto, Kawasaki (JP); Tomohisa Shingai, Kawasaki (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 11/255,104

(22) Filed: Oct. 21, 2005

(65) Prior Publication Data

US 2006/0066693 A1 Mar. 30, 2006

Related U.S. Application Data

(60) Division of application No. 10/921,319, filed on Aug. 19, 2004, now Pat. No. 6,988,792, which is a division of application No. 10/259,611, filed on Sep. 30, 2002, now Pat. No. 6,796,638, which is a continuation of application No. PCT/JP00/02138, filed on Mar. 31, 2000.

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS

| | | | | |
|---|---|---|---|---|
| 4,825,227 | A | 4/1989 | Fischbeck et al. | 346/1.1 |
| 5,754,205 | A | 5/1998 | Miyata et al. | 347/70 |
| 5,929,881 | A | 7/1999 | Kitahara et al. | 347/70 |
| 6,142,615 | A | 11/2000 | Qiu et al. | 347/70 |
| 6,336,717 | B1 | 1/2002 | Shimada et al. | 347/71 |
| 6,364,468 | B1 | 4/2002 | Watanabe et al. | 347/68 |
| 6,609,785 | B1 | 8/2003 | Hashizume et al. | 347/70 |
| 6,682,180 | B1 | 1/2004 | Sakamoto et al. | 347/70 |

FOREIGN PATENT DOCUMENTS

| | | |
|---|---|---|
| EP | 0 800 920 A2 * | 10/1997 |
| JP | 7-290703 | 11/1995 |
| JP | 11-70653 | 3/1999 |
| JP | 11-70654 | 3/1999 |

(Continued)

OTHER PUBLICATIONS

Copy of International Search Report received PCT/JP00/02138, dated Jul. 11, 2000, 2 pages.

*Primary Examiner*—Stephen Meier
*Assistant Examiner*—Geoffrey S Mruk
(74) *Attorney, Agent, or Firm*—Armstrong, Kratz, Quintos, Hanson & Brooks, LLP

(57) ABSTRACT

A multi-nozzle ink jet head formed through semiconductor processes. The multi-nozzle head has a head substrate in which are formed a plurality of nozzles and a plurality of pressure chambers, a diaphragm that acts as a common electrode and covers the plurality of pressure chambers, piezoelectric body layers that are provided in correspondence with the pressure chambers on the diaphragm, and individual electrode layers that are provided on the piezoelectric body layers and have individual electrode parts corresponding to the pressure chambers and wiring parts for the individual electrode parts. By interposing a low-dielectric-constant layer or an insulating layer in the region of the wiring parts, or not disposing the common electrode in the region of the wiring parts, the electrical capacitance of the driving parts is reduced, and hence a driving lag is prevented from occurring, and moreover unwanted vibration of the piezoelectric bodies is prevented.

2 Claims, 12 Drawing Sheets

FOREIGN PATENT DOCUMENTS

| | | |
|---|---|---|
| JP | 11-91100 | 4/1999 |
| JP | 11-157070 | 6/1999 |
| JP | 2000-37868 | 2/2000 |
| JP | 2000-52555 | 2/2000 |
| JP | 2000-168072 | 6/2000 |
| WO | WO 01/42017 A1 | 12/1999 |

* cited by examiner

MULTI-NOZZLE INK JET HEAD

RELATED APPLICATIONS

This application is a divisional application of U.S. application Ser. No. 10/921,319, filed Aug. 19, 2004, now U.S. Pat. No. 6,988,792, which is a divisional application of U.S. application Ser. No. 10/259,611, filed Sep. 30, 2002, now U.S. Pat. No. 6,796,638, which is a continuation of International Application No. PCT/JP00/02138, filed Mar. 31, 2000, all of which are incorporated herein by reference.

BACKGROUND OF THE INVENTION

1. Field of the Invention

The present invention relates to an ink jet head for applying pressure to pressure chambers and thus ejecting ink drops from nozzles, and in particular to a multi-nozzle ink jet head for performing lead out of electrodes from a row of piezoelectric bodies using a laminate of the elements.

2. Description of the Related Art

An ink jet recording head has nozzles, ink chambers, an ink supply system, an ink tank, and transducers; by transmitting displacement/pressure generated by the transducers to the ink chambers, ink particles are ejected from the nozzles, and characters or images are recorded on a recording medium such as paper.

In a well-known form, a thin-plate-shaped piezoelectric element having the whole of one surface thereof bonded to the outer wall of an ink chamber is used as each transducer. A pulse-like voltage is applied to the piezoelectric element, thus bending the composite plate comprising the piezoelectric element and the outer wall of the ink chamber, and the displacement/pressure generated through the bending is transmitted to the inside of the ink chamber via the outer wall of the ink chamber.

A sectioned perspective view of a conventional multi-nozzle ink jet head 100 is shown in FIG. 21. As shown in FIG. 21, the head 100 is constituted from a row of piezoelectric bodies 111, individual electrodes 112 that are formed on the piezoelectric bodies, a nozzle plate 114 in which are provided nozzles 113, ink chamber walls 117 made of a metal or a resin that, along with the nozzle plate 114, form ink chambers 115 corresponding to the nozzles 113, and a diaphragm 116.

A nozzle 113 and a piezoelectric body 111 are provided for each ink chamber 115, and the periphery of each ink chamber 115 and the periphery of the corresponding part of the diaphragm 116 are connected together strongly. A piezoelectric body 111 for which a voltage has been applied to the individual electrode 112 deforms the corresponding part of the diaphragm 116 as shown by the dashed lines in the drawing. As a result, an ink drop is ejected from the nozzle 113.

Application of voltages to each of the piezoelectric bodies 111 is carried out separately using electrical signals from a printing apparatus main body via printed circuit boards. FIG. 22 is a drawing showing the constitution of connections between the conventional head and the printed circuit boards. In the example of FIG. 22, the head 100 has 8 rows and 8 columns of nozzles 113, i.e. of piezoelectric bodies 111 and individual electrodes 112. Corresponding to this, flexible printed circuit boards 110 are provided for connecting the driver circuitry of the apparatus and the individual electrodes 112 together.

In this prior art, the terminals of the printed circuit boards 110 are connected to the respective individual electrodes 112 by wires 120 through wire bonding. Moreover, art in which an FPC wiring board is connected directly is also known.

Moving on, due to demands to increase printing resolution, there are demands to increase the density of the nozzle arrangement of heads. If the nozzle density is raised, then the contact spacing between terminals (individual electrodes) is reduced. For example, the nozzle density of a head using piezoelectric bodies is currently about 150 dpi, but is advancing to 180~300 dpi, and further to 360 dpi, and hence the contact spacing is becoming lower. However, currently the best contact spacing with wire bonding using semiconductor manufacturing is 150 dpi, with 300 dpi contacts being developed in the case of FPC connection.

Consequently, if electrical connection is carried out by providing contacts on top of or near to the piezoelectric bodies 111 as conventionally, then a problem of joining of neighboring contacts (shorting) may arise. Moreover, when connecting a large number of points in a short time, the load on the piezoelectric bodies 111 becomes very high, and with thin-film piezoelectric bodies there is a risk of breakage, and hence connection is extremely problematic.

SUMMARY OF THE INVENTION

It is an object of the present invention to provide a multi-nozzle ink jet head for carrying out connection at a position away from the driving parts of the pressure chambers, thus preventing there being an effect on the driving characteristics even if a load is applied during the connection.

Moreover, it is another object of the present invention to provide a multi-nozzle ink jet head for preventing a lag in the driving operation of the piezoelectric bodies relative to the input waveform even though the led out wiring parts have a piezoelectric body actuator laminated structure.

Furthermore, it is yet another object of the present invention to provide a multi-nozzle ink jet head for preventing expansion and contraction of the piezoelectric bodies at the led out wiring parts even though these wiring parts have a piezoelectric body actuator laminated structure.

To attain these objects, one form of the multi-nozzle ink jet head of the present invention has a head substrate in which are formed a plurality of nozzles and a plurality of pressure chambers, a diaphragm that also acts as a common electrode and covers the plurality of pressure chambers, piezoelectric body layers that are provided in correspondence with the pressure chambers on the diaphragm, individual electrode layers that are provided on the piezoelectric body layers and have individual electrode parts corresponding to the pressure chambers and wiring parts for the individual electrode parts, and a low-dielectric layer or an insulating layer that is provided between the piezoelectric body layers and the diaphragm in the region of the wiring parts.

Firstly, a novel multi-nozzle ink jet head structure for which a PCT application (PCT/JP/99/06960) was filed by the present applicant on Dec. 10, 1999 is a prerequisite of the present invention. With this structure, the piezoelectric body layers are provided even in regions other than the regions of the pressure chambers, and wiring parts from the individual electrodes are formed on the piezoelectric body layers, and hence connection to the outside of the head can be carried out at a position away from the row of the piezoelectric bodies of the pressure chambers.

The present invention further improves the characteristics of a head of this structure, improving the drop in the characteristics caused by the wiring parts having the piezoelectric body actuator laminated structure. That is, with the structure described above, the electrical capacitance of the wiring parts is added, and hence a lag arose in the driving operation of the piezoelectric bodies relative to the input waveform, and moreover the piezoelectric bodies expanded and contracted at the wiring parts, and hence there was a risk of structural problems (structural cross talk, breaking off of joining parts etc.) arising in the head.

With the present form of the present invention, by forming a low-dielectric layer or an insulating layer between the piezoelectric body layers and the diaphragm in the region of the wiring parts, the electrical capacitance of the wiring parts can be reduced. A lag in the driving operation due to the electrical capacitance can thus be prevented, and moreover structural problems in the head can be prevented.

Moreover, with the multi-nozzle ink jet head of the present invention, by constituting the low-dielectric layer or insulating layer from a flattening layer that flattens between the piezoelectric body layers, the layer for reducing the above-mentioned electrical capacitance can be formed during the flattening layer formation step, and hence the manufacturing process can be shortened.

The multi-nozzle ink jet head of another form of the present invention has a head substrate in which are formed a plurality of nozzles and a plurality of pressure chambers, a diaphragm that also acts as a common electrode and covers the plurality of pressure chambers, piezoelectric body layers that are provided in correspondence with the pressure chambers on the diaphragm, and individual electrode layers that are provided on the piezoelectric body layers and have individual electrode parts corresponding to the pressure chambers and wiring parts for the individual electrode parts, wherein the diaphragm is provided in a region other than the region of the wiring parts.

With this form of the present invention, the diaphragm is not formed at the wiring parts, and hence the electrical capacitance of the wiring parts can be eliminated. Moreover, expansion and contraction of the piezoelectric bodies at the wiring parts can be prevented.

Moreover, with the multi-nozzle ink jet head of the present invention, by providing an insulating layer in the region of the wiring parts in the same layer position as the diaphragm, breakage of the wiring parts can be prevented.

A multi-nozzle ink jet head of yet another form of the present invention has a head substrate in which are formed a plurality of nozzles and a plurality of pressure chambers, a diaphragm that also acts as a common electrode and covers the plurality of pressure chambers, piezoelectric body layers that are provided in correspondence with the pressure chambers on the diaphragm, and individual electrode layers that are provided on the piezoelectric body layers and have individual electrode parts corresponding to the pressure chambers and wiring parts for the individual electrode parts, wherein the diaphragm has a common electrode layer provided in a region other than the region of the wiring parts, and a rigid layer.

With this form of the present invention, in a head having a structure with a laminated type diaphragm (electrode layer, plus rigid layer having mechanical strength), the electrode layer of the diaphragm is not formed at the wiring parts, and hence the constitution is such that the electrical capacitance of the wiring parts is eliminated, and moreover expansion and contraction at the wiring parts is eliminated.

With the multi-nozzle ink jet head of the present invention, by providing the rigid layer in the regions of both the wiring parts and the individual electrode parts, breakage of the wiring parts can be prevented.

Other objects and forms of the present invention will become apparent from the following description of embodiments and the drawings.

DETAILED DESCRIPTION OF THE PREFERRED EMBODIMENTS

Next, embodiments of the present invention will be described along with the drawings.

Figure 1:
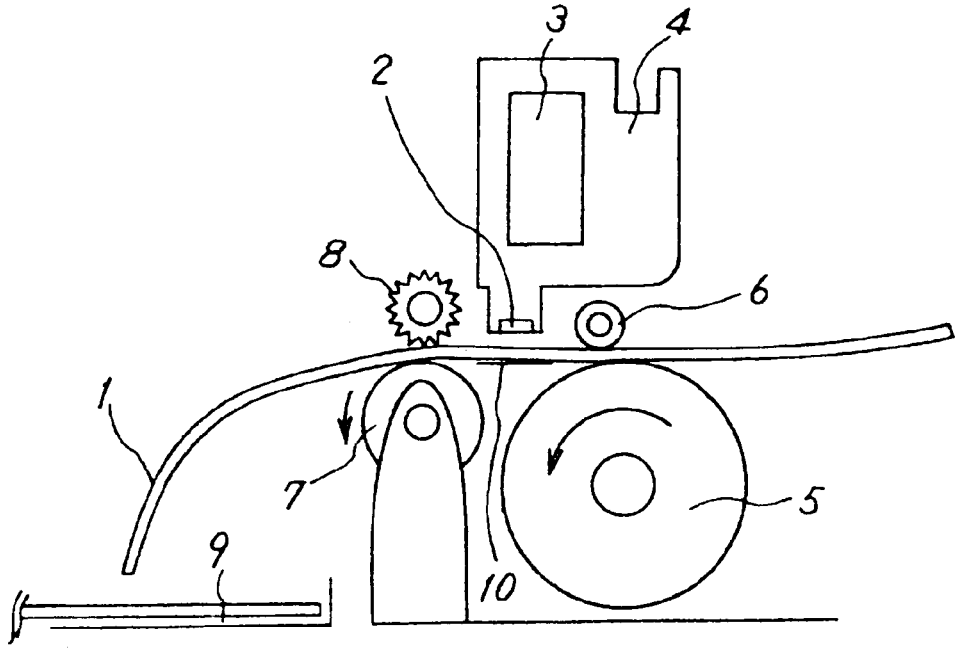
FIG. 1 is a drawing of the constitution of a printer using a multi-nozzle ink jet head of the present invention.

FIG. 1 is a side view of an ink jet recording apparatus using an ink jet head. In the drawing, "1" is a recording medium, on which processing such as printing is carried out using the ink jet recording apparatus. "2" is the ink jet recording head, which ejects ink onto the recording medium 1. "3" is an ink tank, which supplies ink to the ink jet recording head 2. "4" is a carriage, which has therein the ink jet recording head 2 and the ink tank 3.

"5" is a feeding roller, and "6" is a pinch roller; these sandwich the recording medium 1 and convey it towards the ink jet recording head 2. "7" is a discharge roller, and "8" is a pinch roller; these sandwich the recording medium 1, and convey it in a discharge direction. "9" is a stacker, which receives the discharged recording medium 1. "10" is a platen, which pushes against the recording medium 1.

With this ink jet recording head 2, processing such as printing is carried out on the medium by applying voltages to expand and contract piezoelectric elements and eject ink through the pressure thus generated.

Figure 2:
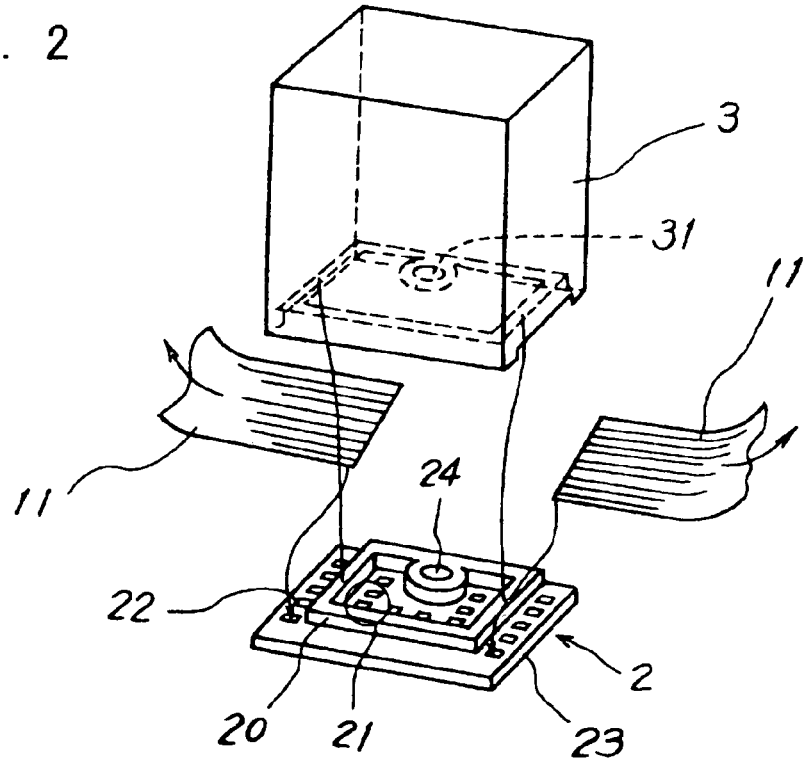
FIG. 2 is a schematic drawing of an ink jet head of an embodiment of the present invention.

FIG. 2 is a drawing of the constitution of peripheral parts of the head of FIG. 1. A main body 23 of the head 2 has a supporting frame 20 for the ink tank 3. An ink supply hole 24 is provided in the supporting frame 20. An ink supply port 31 is provided in the ink tank 3. By setting the ink tank 3 on the supporting frame 20 of the head main body 23, the ink in the ink tank 3 is supplied to the head main body 23. The ink tank 3 on the head 23 is thus interchangeable.

The head main body 23 has a large number of nozzles. Here, individual electrodes 21 of the nozzles are shown on the head main body 23. These individual electrodes 21 are provided inside the supporting frame 20. Outside the supporting frame 20 of the head main body 23 are provided connection terminals 22 for the individual electrodes 21 and a common electrode. The connection terminals 22 are connected to the individual electrodes 21, as will be described later. Terminals of a flexible print cable (FPC) 11 are connected to the connection terminals 22. The nozzle part structure is thus not subjected to a load upon connecting the FPC 11. Connection is thus possible without any effects on the nozzle part even if the nozzle density is high and hence the terminal spacing is low.

Figure 3:
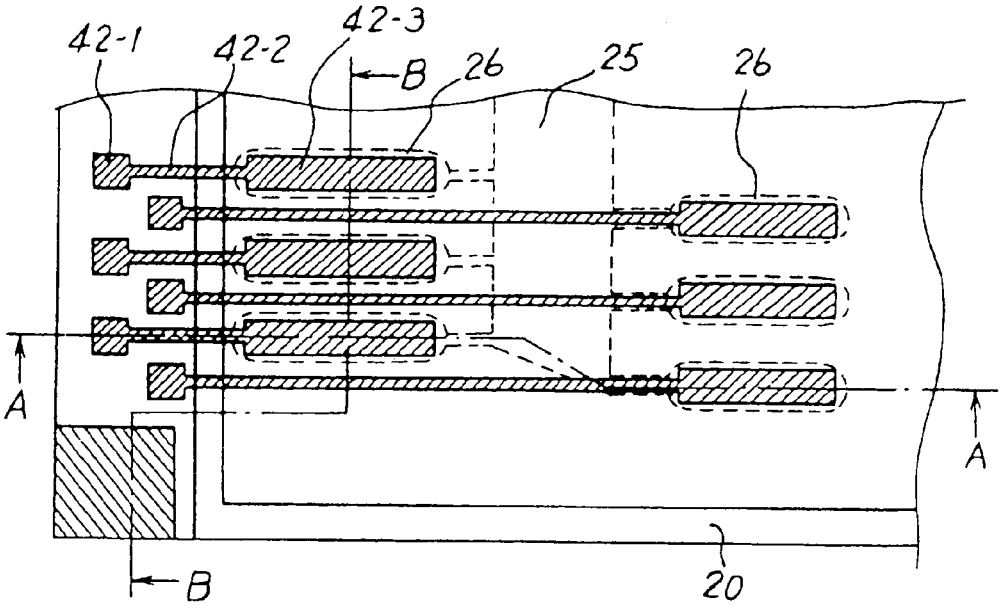
FIG. 3 is a top view of an ink jet head of a prior application that is a prerequisite of the present invention.

Before describing embodiments of the present invention, a description will be given through FIGS. 3 to 5 of the structure of a novel multi-nozzle ink jet head that is a prerequisite of the present invention and for which a PCT application (PCT/JP99/06960) was filed on Dec. 10, 1999 by the present applicant. FIG. 3 is a top view of the head, FIG. 4 is a sectional view along A—A in FIG. 3, and FIG. 5 is a sectional view along B—B in FIG. 3.

Figure 4:
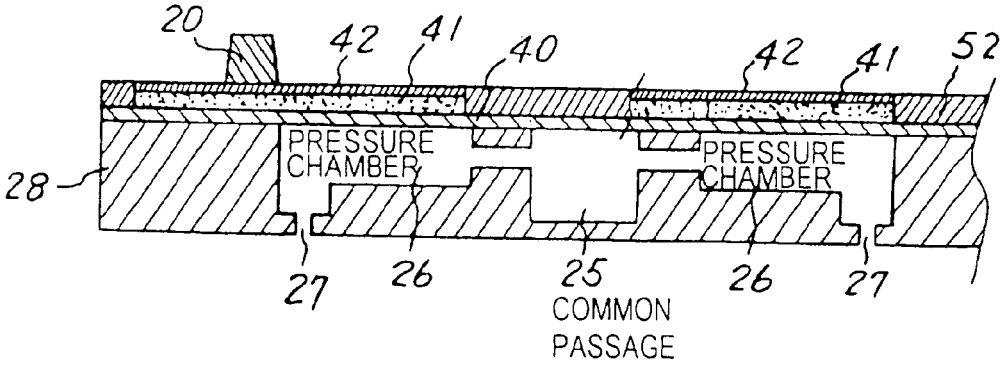
FIG. 4 is a sectional view along A—A in FIG. 3.
Figure 5:
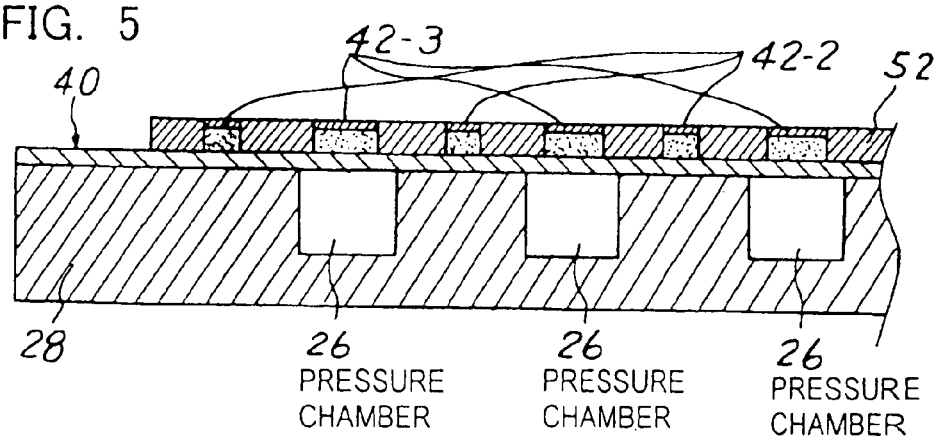
FIG. 5 is a sectional view along B—B in FIG. 3.

As shown in FIG. 4, formed in a head substrate 28 are a common ink channel 25, a large number of pressure chambers 26 that are connected to the common ink channel 25, and nozzles 27 that are connected to the pressure chambers 26. The head substrate 28 is formed through semiconductor processes. A diaphragm 40 is provided so as to cover the pressure chambers 26 in the head substrate 28. The diaphragm 40 is formed, for example, from an electrically conductive film of Cr or the like, and fulfills the function of a common electrode.

Piezoelectric layers 41 are provided on the diaphragm 40. These piezoelectric layers 41 are provided independently in correspondence with the respective pressure chambers 26. Individual electrode layers 42 are provided on the piezoelectric layers 41. The individual electrode layers 42 are also provided independently on the respective piezoelectric layers 41.

As shown in FIG. 3, each individual electrode layer 42 comprises an individual electrode 42-3 disposed in the position of the respective pressure chamber 26, a terminal 42-1 disposed at an edge of the head 23, and a connecting part 42-2 that connects the individual electrode 42-3 and the terminal 42-1 together. Connection to an external FPC 11 can thus be carried out using the terminals 42-1 disposed at the outer periphery of the head main body 23, and hence connection can be carried out without subjecting the piezoelectric layers 41 and the individual electrodes 42-3 of the pressure chambers 26 to a load. Damage to the driving parts can thus be prevented even if the piezoelectric layers 41 and the individual electrodes 42-3 are made thin down to the order of microns so that the nozzles can be formed to high density.

With this structure, as shown in FIGS. 4 and 5, the piezoelectric layers 41 exist even underneath the connecting parts 42-2 and the terminals 42-3, which constitute the wiring parts of the individual electrode layers 42, thus forming piezoelectric actuator laminated structures. The function expected of the piezoelectric layers 41 is to apply energy for ejecting ink to the pressure chambers 26, and hence the piezoelectric layers 41 are not required at the wiring parts.

However, to form a head with a high nozzle density, the dimensions of the various parts become of the order of microns, and hence it is necessary to carry out the manufacture using semiconductor processes. In this case, because both an individual electrode layer 42 and a piezoelectric layer 41 are formed for each pressure chamber 26, it is advantageous in terms of the manufacturing process to form both using the same mask. Moreover, in the case of etching metal to form the individual piezoelectric layers 41, it is extremely difficult to carry out the formation without damaging the individual electrode layers 42, and hence implementing this is hard. Consequently, in the prior application described above, the piezoelectric layers were left behind even at the wiring parts.

In a head that uses thin-film piezoelectric bodies as indicated above and has a high-density nozzle arrangement, it has been found that in the case that the wiring is led out to a position away from the row of piezoelectric bodies, there are the following points which should be improved upon.

Firstly, the led out wiring parts have a piezoelectric body actuator laminated structure, and hence the electrical capacitance of the wiring parts is added, and thus a lag arises in the driving operation of each piezoelectric body relative to the input waveform.

Secondly, because the led out wiring parts have the piezoelectric body actuator laminated structure, the piezoelectric bodies expand and contract at the wiring parts, and hence structural problems (structural cross talk, breaking off of joining parts etc.) arise in the head.

To resolve the above, in the present invention, the effects of the piezoelectric bodies at the wiring parts are suppressed; following is a description of embodiments.

[First Embodiment]

Figure 6:
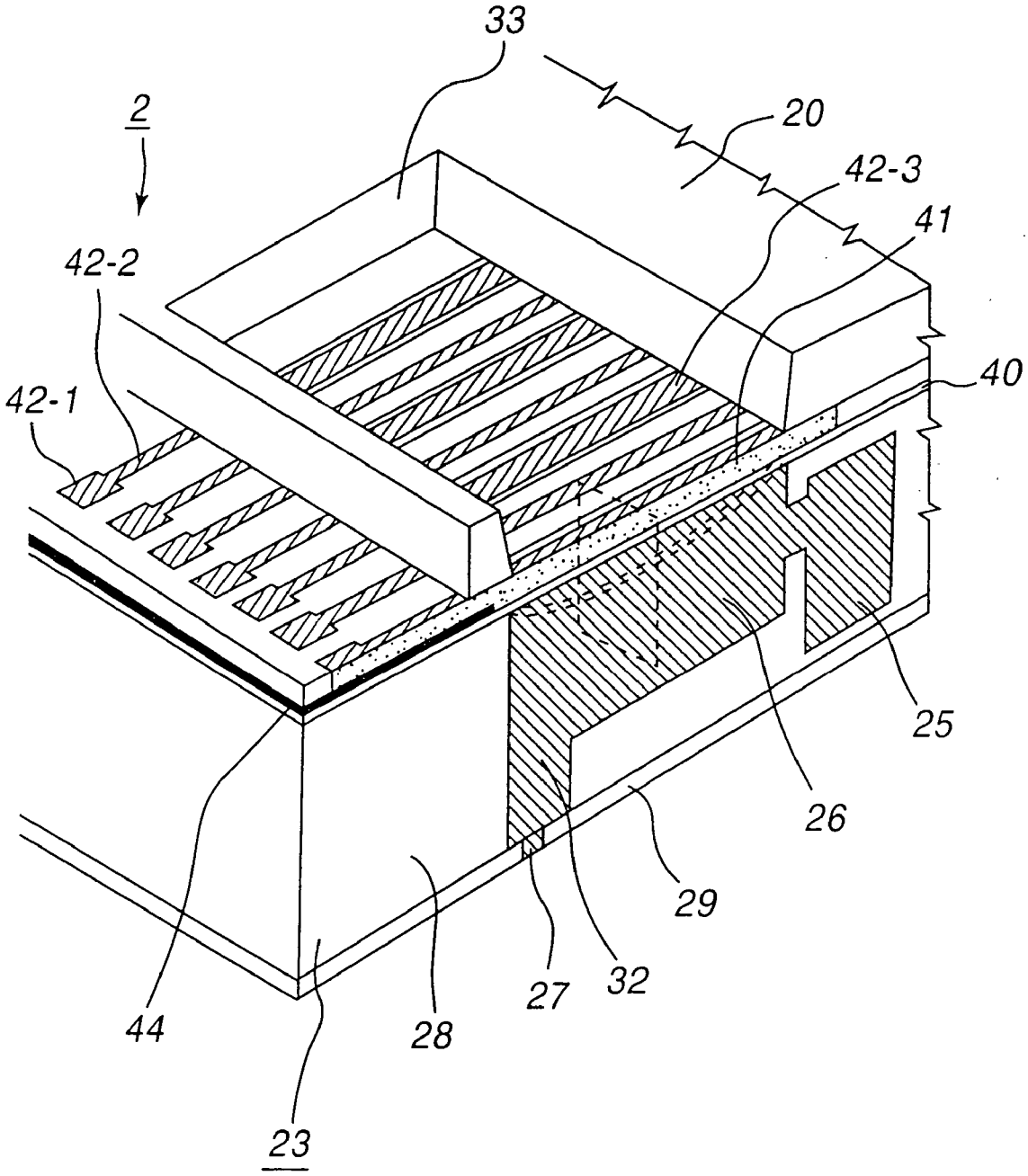
FIG. 6 is a drawing of the constitution of a first embodiment of the present invention.

FIG. 6 is a perspective view of the constitution of an ink jet head 23 of a first embodiment of the present invention, and FIGS. 7 to 9 consist of process drawings for explaining a method of manufacturing the ink jet head of the first embodiment of the present invention.

As shown in FIG. 6, broadly speaking the ink jet head 2 is constituted from a substrate 20, a diaphragm 40, a main body part 28, a nozzle plate 29, ink ejection energy generating parts and so on. The main body part 28 has a structure in which dry films are laminated as will be described later, and inside thereof are formed a plurality of pressure chambers (ink chambers) 26 and an ink channel 25 that acts as a supply channel for the ink. Moreover, the top part in the drawing of each pressure chamber 26 is made to be a free part, and an ink lead-through channel 32 is formed in the bottom surface of each pressure chamber 26.

Moreover, the nozzle plate 29 is disposed on the bottom surface in the drawing of the main body part 28, and the diaphragm 40 is disposed on the top surface. The nozzle plate 29 is made for example of stainless steel, and has nozzles 27 formed therein in positions facing the ink lead-through channels 32.

Moreover, in the present embodiment, chromium (Cr) is used for the diaphragm 40, and the energy generating parts are disposed thereupon. The substrate 20 is made for example of magnesium oxide (MgO), and an opening part 33 is formed in a central position thereof. The energy generating parts are formed on the diaphragm 40 so as to be exposed via the opening part 33.

Each energy generating part is constituted from the diaphragm 40 (which also acts as a common electrode), an individual electrode 42-3 and a piezoelectric body 41. The energy generating parts are formed in positions corresponding to the positions of formation of the pressure chambers 26, a plurality of which are formed in the main body part 28.

The individual electrodes 42 are made, for example, of platinum (Pt), and are formed on the upper surfaces of the piezoelectric bodies 41. Moreover, the piezoelectric bodies 41 are crystalline bodies that generate piezoelectricity, and in the present embodiment the constitution is such that each is formed independently in the position of formation of the respective pressure chamber 26 (i.e., neighboring energy generating parts are not connected to one another).

Moreover, outside the opening part 33 of the substrate 20, the head has terminal parts 42-1 of the individual electrodes where the laminate structure is led out as is. Furthermore, the terminal parts 42-1 are connected to the individual electrodes 42-3 by connecting parts 42-2, and are formed from an integrated electrode layer.

A characteristic feature of the present embodiment is that a low-dielectric-constant layer (or insulating layer) 44 is provided between the diaphragm 40 and the piezoelectric bodies 41 in the position of the wiring parts, i.e., just after entering the wall 28 from the pressure chambers 26. The electrical capacitance of the wiring parts is thus reduced, and hence when a driving voltage is applied to an individual electrode 42, a lag in the driving operation of the piezoelectric body relative to the input waveform can be prevented from occurring. That is, high-speed driving becomes possible, and moreover the ink particle formation speed can be prevented from dropping.

Moreover, in the ink jet head made to have the constitution described above, if a voltage is applied between the diaphragm 40, which also acts as the common electrode, and an individual electrode 42-3, then distortion is generated in the piezoelectric body 41 due to the phenomenon of piezoelectricity. Even though distortion is generated in the piezoelectric body 41 in this way, the diaphragm 40, which is a rigid body, tries to maintain its state; consequently, in the case for example that the piezoelectric body 41 distorts in a direction so as to contract through the application of the voltage, then deformation occurs such that the diaphragm 40 side becomes convex. The diaphragm 40 is fixed at the periphery of the pressure chamber 26, and hence the diaphragm 40 deforms into a shape that is convex towards the pressure chamber 26, as shown by the dashed lines in the drawing.

Consequently, due to the deformation of the diaphragm 40 accompanying the distortion of the piezoelectric body 41, the ink in the pressure chamber 26 is pressurized, and hence is ejected to the outside via the ink lead-through channel 32 and the nozzle 27, and as a result printing is carried out on the recording medium.

With the ink jet head 2 according to the present embodiment having the above constitution, the diaphragm 40, and the individual electrodes 42 and the piezoelectric bodies 41, which constitute the energy generating parts, are formed using thin film formation technology (the manufacturing method will be described in detail later).

By forming the diaphragm 40 and the energy generating parts using thin film formation technology in this way, it is possible to form thin, miniaturized energy generating parts with high precision and high reliability. It is thus possible to reduce the power consumption of the ink jet head 2, and moreover high-resolution printing can be made possible.

Moreover, with the present embodiment, the constitution is such that the energy generating parts are divided, with each energy generating part being in a position corresponding to one of the pressure chambers 26. Each energy generating part can thus displace without being constrained by the neighboring energy generating parts. The applied voltage required for ink ejection can thus be reduced, and hence the power consumption of the ink jet head can also be reduced due to this.

Here, as described earlier, a low-dielectric-constant layer (or insulating layer) 44 is formed between the piezoelectric bodies 41 and the diaphragm 40 at the wiring parts, and hence the electrical capacitance of the wiring parts is reduced, and thus when a driving voltage is applied as described above, a lag in the driving relative to the input waveform can be prevented from occurring. Moreover, the effective voltage applied to the piezoelectric body at the wiring part is also reduced, and hence movement of the piezoelectric body at this part can be suppressed. Consequently, cross talk and breaking off of joining parts can be prevented.

Next, a method of manufacturing the ink jet head 2 having the constitution described above will be described using FIGS. 7 to 9.

Figure 7A:
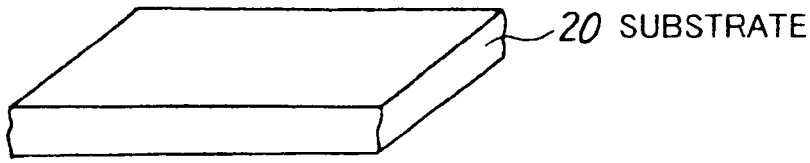
FIGS. 7(A), 7(B), 7(C), 7(D) and 7(E) consist of (first) explanatory drawings of a manufacturing process of the head of FIG. 6.

To manufacture the ink jet head 2, firstly a substrate 20 is prepared as shown in FIG. 7(A). In the present embodiment, a magnesium oxide (MgO) monocrystal of thickness 0.3 mm is used as the substrate 20. An individual electrode layer 42 (hereinafter referred to merely as the "electrode layer") and a piezoelectric body layer 41 are formed in order on the substrate 20 using sputtering, which is a thin film formation technique.

Figure 7B:
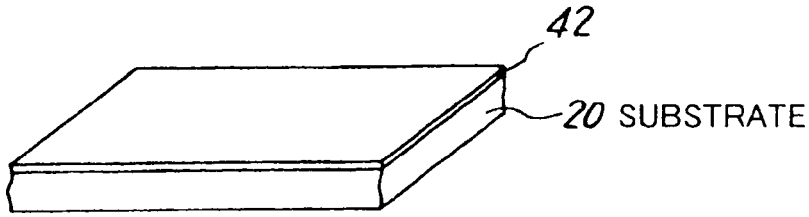
Figure 7C:
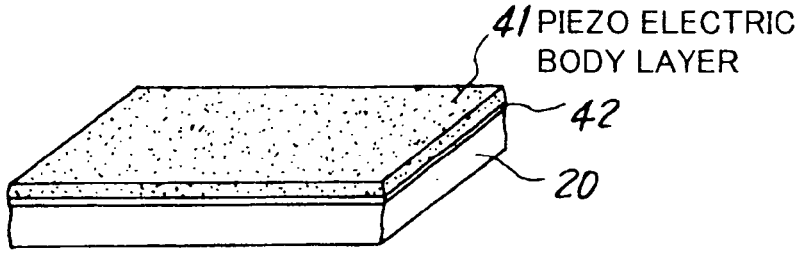

Specifically, firstly the electrode layer 42 is formed on the substrate 20 as shown in FIG. 7(B), and then the piezoelectric body layer 41 is formed on the electrode layer 42 as shown in FIG. 7(C). In the present embodiment, platinum (Pt) is used as the material of the electrode layer 42.

Figure 7D:
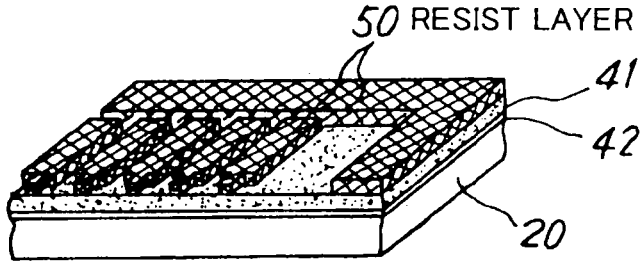

Next, a milling pattern for dividing the above laminate into portions in positions corresponding to the pressure chambers that will be formed later is formed from a dry film resist (hereinafter referred to as "DF-1") 50. FIG. 7(D) shows the state after the DF-1 pattern 50 has been formed; the DF-1 pattern 50 is formed in places where the electrode layer 42 and the piezoelectric body layer 41 are to be left behind. In the present embodiment, FI-215 (made by Tokyo Ohka Kogyo Co., Ltd.; alkali type resist, thickness 15 μm) was used as the DF-1, and after laminating on at 2.5 kgf/cm, 1 m/s and 115° C., 120 mJ exposure was carried out with a glass mask, preliminary heating at 60° C. for 10 minutes and then cooling down to room temperature were carried out, and then developing was carried out with a 1 wt % $Na_2CO_3$ solution, thus forming the pattern.

Figure 7E:
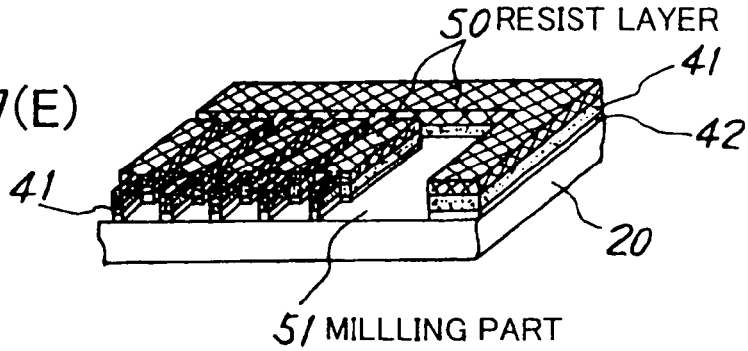

The substrate was fixed to a copper holder using grease (Apiezon L Grease) having good thermal conductivity, and milling was carried out at 700V using Ar gas only with an irradiation angle of 15° C. As a result, the shape became as shown in FIG. 7(E), with the taper angle in the depth direction of the milled parts 51 becoming perpendicular, i.e., at least 85° C., relative to the surface.

Next, (although not shown) after stripping off the resist layer 50, a resist was once again laminated over the whole surface, a pattern was formed that was open at only the wiring parts led out from the driving element parts, and milling was carried out. The milling was carried out such that 0.7 μm was removed from the piezoelectric body layers 41. Note that the flattening rate of the flattening resin in the next step is 80% or more, and hence in the case that the piezoelectric body layers 41 are 2 to 3 μm, the maximum depressions that arise are about 0.6 μm, and hence if a thickness of 0.7 μm is formed, then the flattening resin will invariably remain at this part.

Figure 8F:
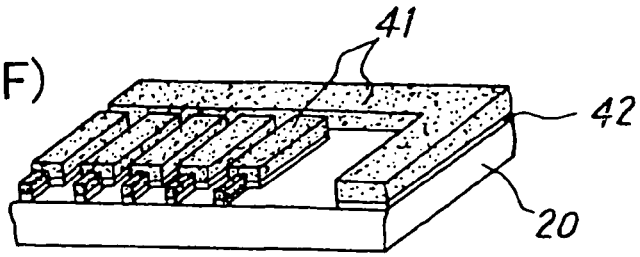
FIGS. 8(F), 8(G), 8(H) and 8(I) consist of (second) explanatory drawings of a manufacturing process of the head of FIG. 6.
Figure 8G:
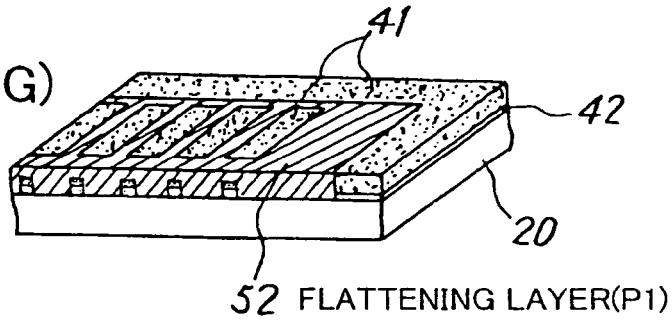

Next, the DF-1 50 is removed as shown in FIG. 8(F), and then, so that the diaphragm 40 can be made flat, and also to carry out insulation between the upper electrodes (electrode layers 42) and the diaphragm 40, which is the common electrode, at the milled parts, an insulating flattening layer 52 is formed in the milled parts, as shown in FIG. 8(G).

Figure 8H:
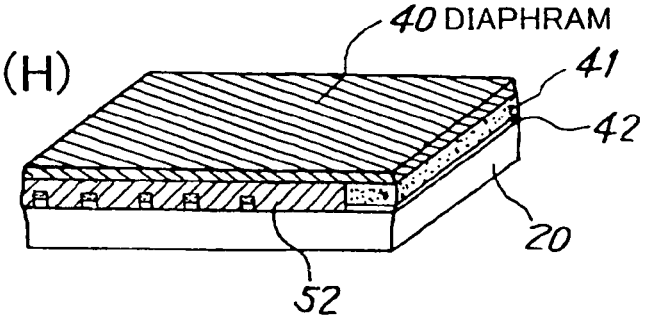

Next, as shown in FIG. 8(H), a laminated type diaphragm 40 is deposited by sputtering, thus forming the actuator parts. The diaphragm 40 was formed by sputtering Cr to 1.5 μm over the whole surface.

Figure 8I:
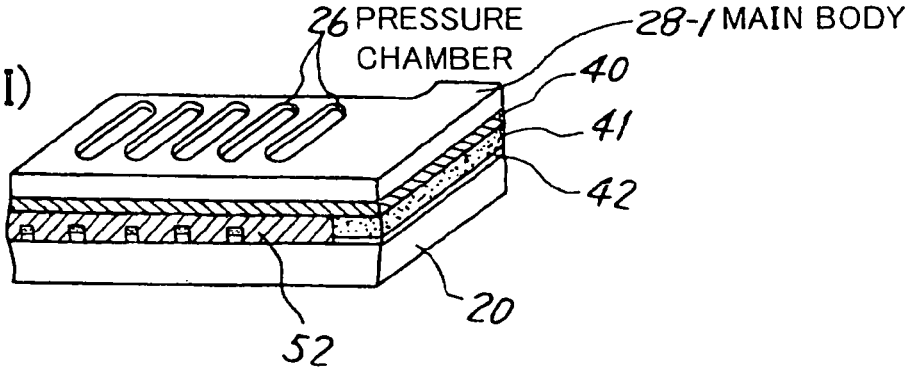

After the formation of the various layers 42 to 40 has been completed using thin film formation techniques as described above, next pressure chamber opening parts 28-1, 26 are formed in positions corresponding to the respective piezoelectric bodies of the layers 42 to 40 as shown in FIG. 8(I). In the present embodiment, the formation was carried out using a solvent type dry film resist (hereinafter referred to as "DF-2") 28-1. The DF-2 used was PR-100 series (made by Tokyo Ohka Kogyo Co., Ltd.); laminating on was carried out at 2.5 kgf/cm, 1 m/s and 35° C., and then using a glass mask, alignment was carried out using alignment marks (not shown) in the pattern for the piezoelectric bodies 42 (and the electrode layers 41) from the time of the milling described earlier and 180 mJ exposure was carried out, preliminary heating at 60° C. for 10 minutes and then cooling to room temperature were carried out, and then developing was carried out using C-3 and F-5 solutions (made by Tokyo Ohka Kogyo Co., Ltd.), thus carrying out pattern formation.

Moreover, a main body part 28-2 having the pressure chambers 26 and a nozzle plate 29 are formed through a process separate to the process described above. The main body part 28-2 having the pressure chambers 26 is formed on the nozzle plate 29 (which has alignment marks, not shown) by laminating on a dry film (PR series solvent type dry film made by Tokyo Ohka Kogyo Co., Ltd.) and exposing a required number of times and then developing.

The specific method of forming the main body part 28-2 is as follows. On the nozzle plate 29 (thickness 20 μm), a pattern of ink lead-through channels 32 (diameter 60 μm; depth 60 μm) for leading ink from the pressure chambers 26 to the nozzles 27 (diameter 20 μm, straight holes) and making the ink flow be in one direction is exposed using the alignment marks on the nozzle plate 29, and then the pressure chambers 26 (width 100 μm, length 1700 μm, thickness 60 μm) are exposed as for the ink lead-through channels 32 using the alignment marks on the nozzle plate 29, next the structure is left naturally (at room temperature) for 10 minutes and then curing is carried out by heating (60° C., 10 minutes), and then unwanted parts of the dry film are removed by solvent developing.

Figure 9J:
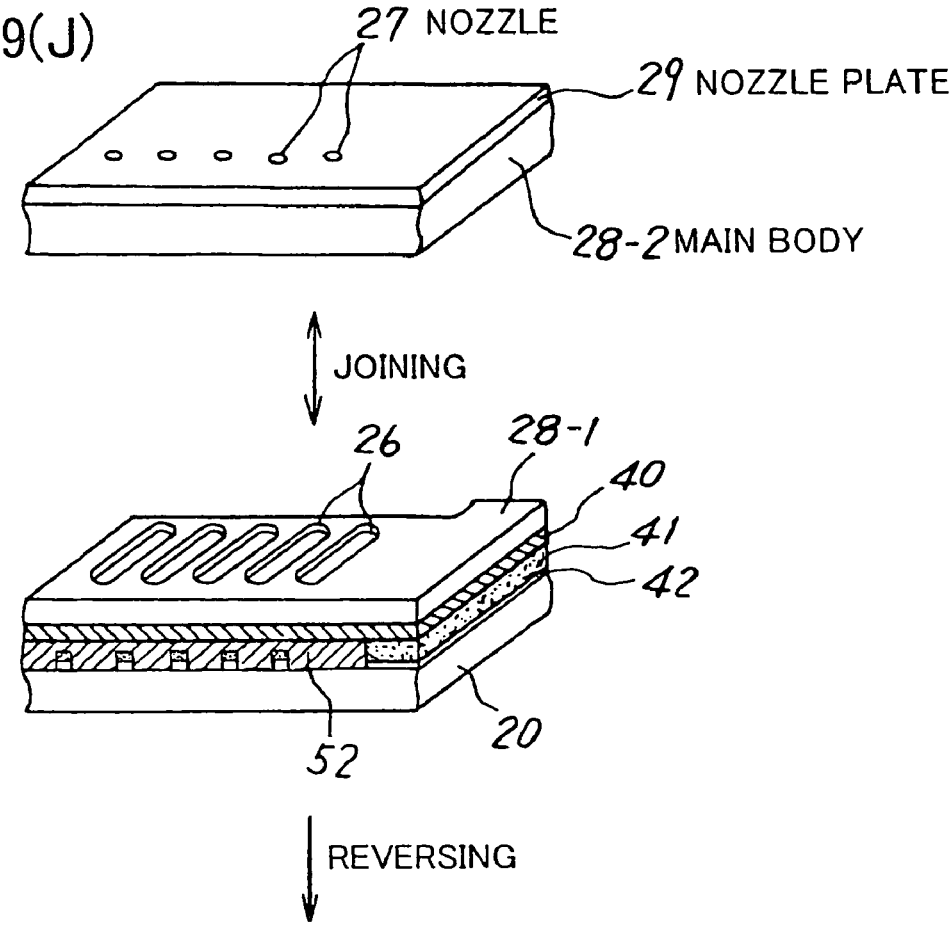
FIGS. 9(J) and 9(K) consist of (third) explanatory drawings of a manufacturing process of the head of FIG. 6.

The main body part 28-2 provided with the nozzle plate 29 formed as described above is joined (joined and fixed) to the other main body part 28-1 (FIG. 8(I)) having the actuator parts as shown in FIG. 9(J). At this time, the joining is carried out such that the main body parts 28-1 and 28-2 face one another accurately at the pressure chamber 26 parts. The joining is carried out using alignment marks on the piezoelectric body parts and alignment marks formed on the nozzle plate, by carrying out, at a load of 15 kgf/cm$^2$, preliminary heating at 80° C. for 1 hour followed by the main joining at 150° C. for 14 hours, and then allowing natural cooling to take place.

Next, the substrate is removed from the driving parts so that the actuators will be able to vibrate. Specifically, the substrate 20 is turned upside down so that the nozzle plate 29 is on the underside, and an opening part is formed by removing approximately the central part of the substrate 20 by etching (removal step).

Figure 9K:
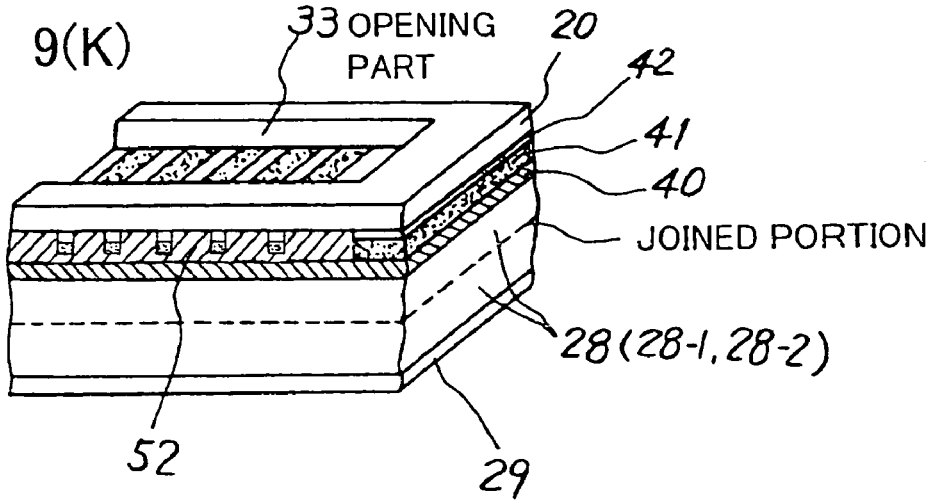

The position in which the opening part is formed is selected so as to correspond to at least the deformation region in which the diaphragm 40 is deformed by the energy generating parts (see FIG. 6). By removing the substrate 20 and forming the opening part 33 in this way, the constitution becomes such that the electrode layers 42 are exposed from the substrate 20 via the opening part 33 as shown in FIG. 9(K).

As described above, each of the electrode layers 42 comprises an individual electrode 42-3 and wiring parts 42-2 and 42-1. Moreover, as shown in FIG. 8(F), a portion of each piezoelectric body layer 41 is removed at the wiring parts, and as shown in FIG. 8(G), an insulating layer (flattening layer) 52 is formed on the piezoelectric body layers 41 at the wiring parts. Consequently, as shown in FIG. 8(H), the insulating layer (flattening layer) 52 is interposed between the piezoelectric body layers 41 and the diaphragm 40 only at the wiring parts.

In this embodiment, the flattening layer is used as the interposed insulating layer 44, and hence the insulating layer can be interposed during the flattening layer formation step.

Moreover, as described above, according to the present embodiment, the energy generating parts are formed on the substrate 20 by forming an electrode layer 42, a piezoelectric body layer 41 and a diaphragm 40 in order using a thin film formation technique such as sputtering; compared with conventionally, thin energy generating parts can thus be formed with higher precision (i.e., with the same shape as the upper electrodes) and with higher reliability.

Furthermore, as an example of a modification of the first embodiment, the insulating layer 44 is formed separately from the flattening layer 52. Specifically, instead of re-milling the piezoelectric body layers at the wiring parts (FIG. 8(F)), after forming the flattening resin layer in FIG. 8(G), the wiring parts are coated with a low-dielectric-constant material or an insulating material, thus forming the insulating layer 44.

In this modification, the insulating layer can be formed from a material different to that of the flattening layer 52. Specifically, for the flattening layer 52, a flexible material, for example a polyimide (PI), is used, so that the driving of the piezoelectric bodies as actuators will not be constrained. However, the insulating layer is provided between the piezoelectric bodies and the diaphragm at the wiring parts, and hence if it is flexible, then the fixing of the diaphragm will become weak, and thus pressure loss will occur. In the case that the insulating layer is formed from a different material to the flattening layer, the stiffness of the material is irrelevant, since it is only electrical characteristics that are required of the low-dielectric-constant layer or insulating layer. For example, a stiff material can be used. The scope of selection of the material thus becomes broad.

[Second Embodiment]

Figure 10:
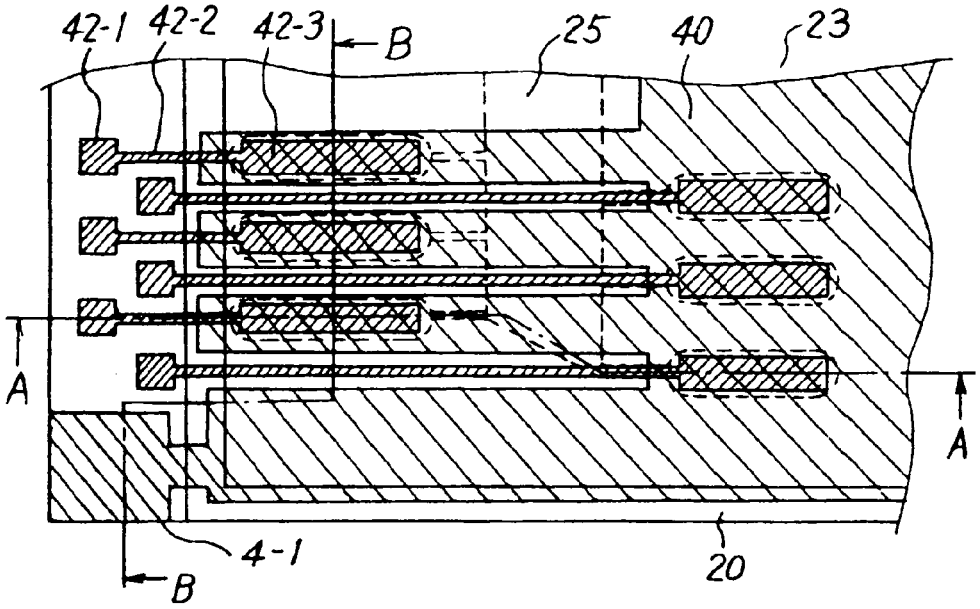
FIG. 10 is a top view of an ink jet head of a second embodiment of the present invention.
Figure 11:
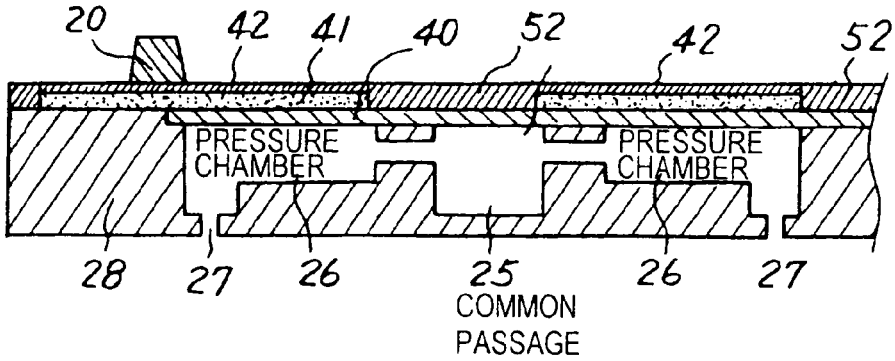
FIG. 11 is a sectional view along A—A in FIG. 10.
Figure 12:
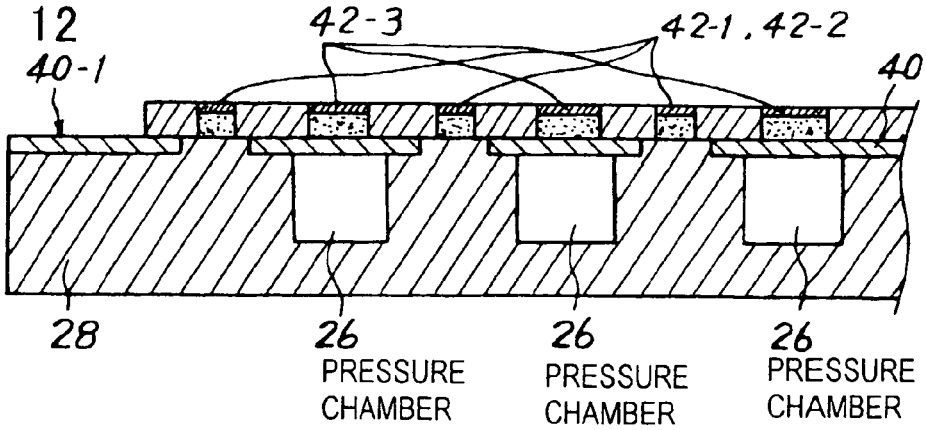
FIG. 12 is a sectional view along B—B in FIG. 10.

FIG. 10 is a top view of a head of a second embodiment of the present invention, FIG. 11 is a sectional view along A—A in FIG. 10, and FIG. 12 is a sectional view along B—B in FIG. 10. The drawings for this embodiment correspond to FIGS. 3 to 5 for the prior application. Elements shown in FIGS. 3 to 5 are thus represented by the same reference numerals.

As shown in FIG. 11, formed in a head substrate 28 are a common ink channel 25, a large number of pressure chambers 26 that are connected to the common ink channel 25, and nozzles 27 that are connected to the pressure chambers 26. The head substrate 28 is formed through semiconductor processes. A diaphragm 40 is provided so as to cover the pressure chambers 26 in the head substrate 28. The diaphragm 40 is formed, for example, from an electrically conductive film of Cr or the like, and fulfills the function of a common electrode.

Piezoelectric layers 41 are provided on the diaphragm 40. These piezoelectric layers 41 are provided independently in correspondence with the respective pressure chambers 26. Individual electrode layers 42 are provided on the piezoelectric layers 41. The individual electrode layers 42 are also provided independently on the respective piezoelectric layers 41.

As shown in FIG. 10, each individual electrode layer 42 comprises an individual electrode 42-3 disposed in the position of the respective pressure chamber 26, a terminal 42-1 disposed at an edge of the head 23, and a connecting part 42-2 that connects the individual electrode 42-3 and the terminal 42-1 together. Connection to an external FPC 11 can thus be carried out using the terminals 42-1 disposed at the outer periphery of the head main body 23, and hence connection can be carried out without subjecting the piezoelectric layers 41 and the individual electrodes 42-3 of the pressure chambers 26 to a load. Damage to the driving parts can thus be prevented even if the piezoelectric layers 41 and the individual electrodes 42-3 are made thin down to the order of microns so that the nozzles can be formed at high density.

With this structure, as shown in FIGS. 11 and 12, the piezoelectric layers 41 exist even underneath the connecting parts 42-2 and the terminals 42-3, which are the wiring parts of the individual electrode layers 42, thus forming piezoelectric actuator laminated structures.

As shown by the oblique lines in FIG. 10, the diaphragm 40 is provided so as to avoid the wiring parts. Consequently, the common electrode is not present at the wiring parts, and hence the electrical capacitance of the wiring parts can be made to be zero. A driving lag of the piezoelectric bodies during driving can thus be prevented. Moreover, because the common electrode is not present at the wiring parts, unwanted movement of the piezoelectric bodies at the wiring parts can be prevented, and hence cross talk and breaking off of joining parts can be prevented.

Figure 13:
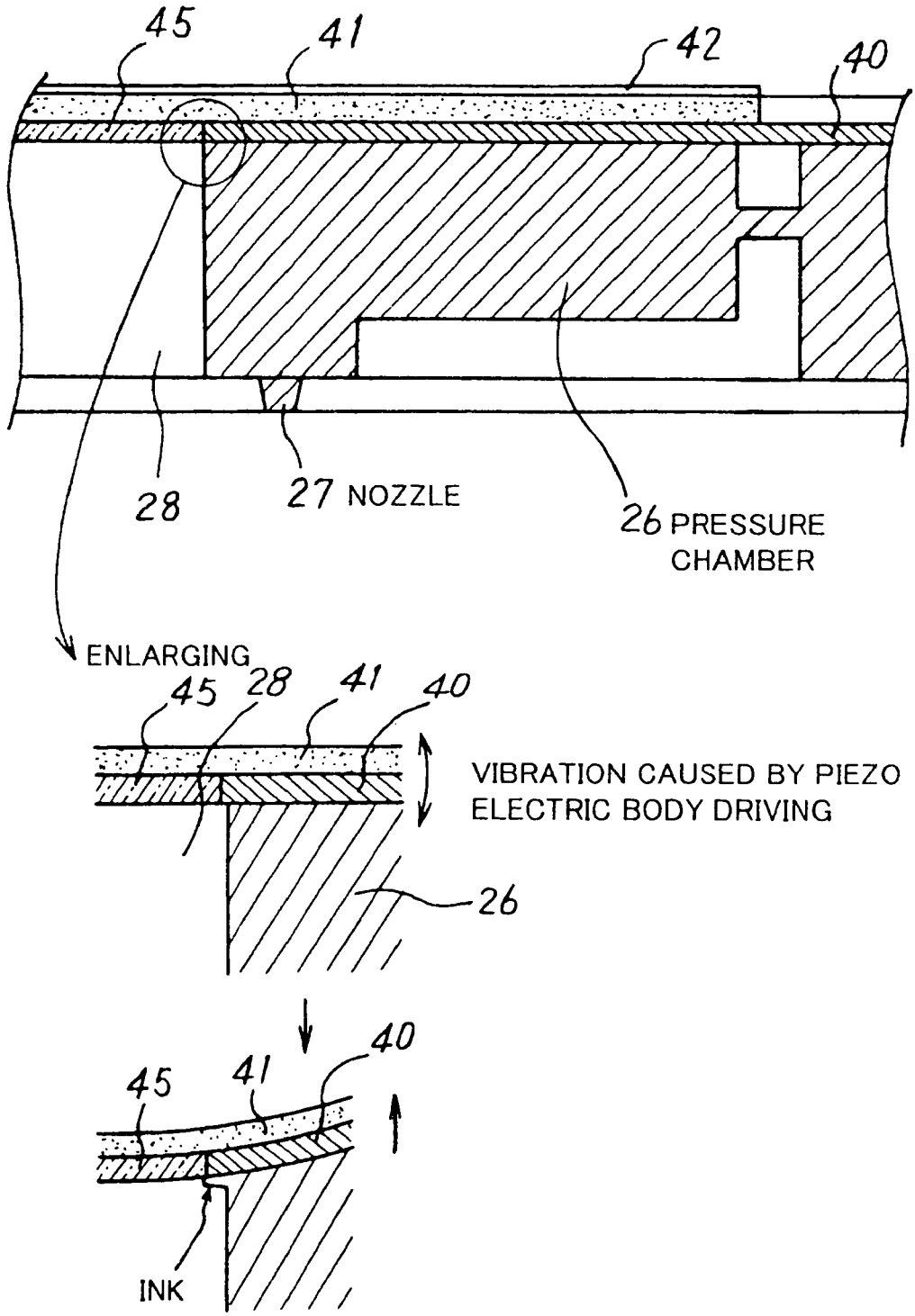
FIG. 13 consists of drawings for explaining the operation of the constitution of FIG. 10.

To form this diaphragm 40, in FIG. 8(H), it is sufficient to carry out pattern formation for the diaphragm 40 as in FIG. 10. Such a diaphragm 40 can thus be realized easily. At this time, by providing an insulating layer 45 under the piezoelectric body layers 41 at the wiring parts where the diaphragm 40 is not formed as shown in FIG. 13, flattening becomes possible.

Note, however, that it is preferable to also provide the diaphragm 40 on the pressure chamber walls 28, so that the diaphragm 40 will be sufficiently supported by the pressure chamber walls 28. For example, as shown in FIG. 13, in the case that the diaphragm 40 does not sufficiently lie on a pressure chamber wall 28, there will be a risk of ink running out from between the pressure chamber wall 28 and the diaphragm 40 due to the vibration of the piezoelectric layer 41 and the diaphragm 40, and this ink entering the flattening layer side from the boundary between the insulating layer 45 and the diaphragm 40, and hence shorting between the diaphragm 40 and the individual electrode layer 42 occurring.

[Third Embodiment]

Figure 14:
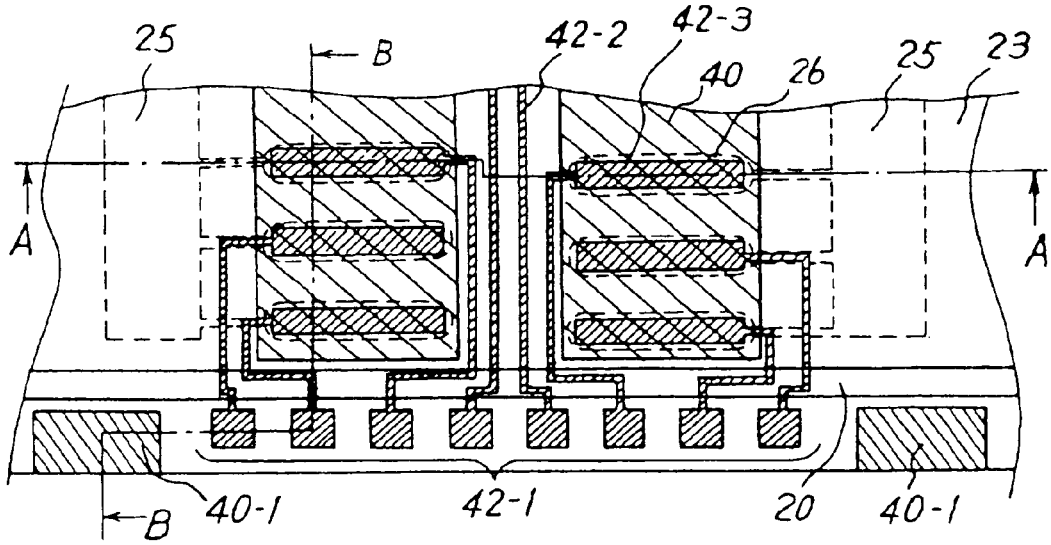
FIG. 14 is a top view of an ink jet head of a third embodiment of the present invention.
Figure 15:
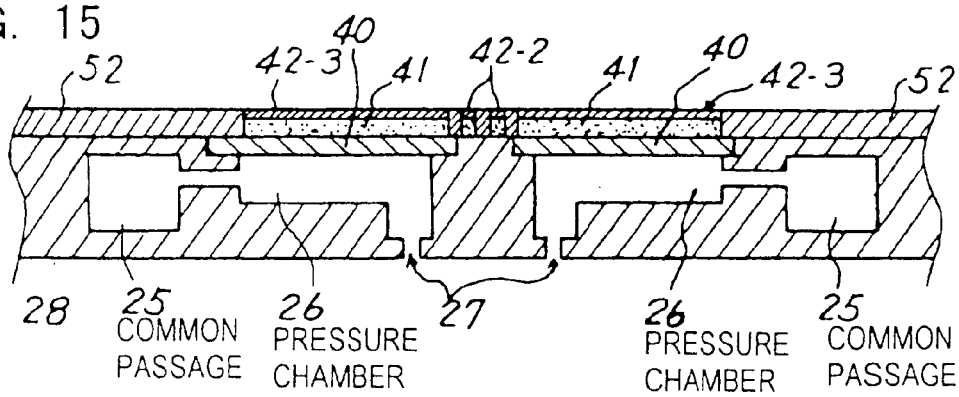
FIG. 15 is a sectional view along A—A in FIG. 14.
Figure 16:
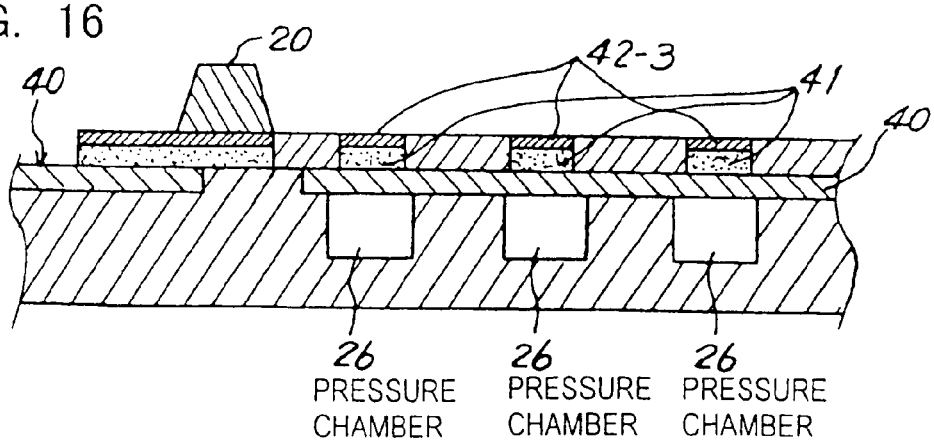
FIG. 16 is a sectional view along B—B in FIG. 14.

FIG. 14 is a top view of a head of a third embodiment of the present invention, FIG. 15 is a sectional view along A—A in FIG. 14, and FIG. 16 is a sectional view along B—B in FIG. 14. In the drawings for this embodiment, elements shown in FIGS. 3 to 5 are represented by the same reference numerals.

As shown in FIG. 15, formed in a head substrate 28 are common ink channels 25, a large number of pressure chambers 26 that are connected to the common ink channels 25, and nozzles 27 that are connected to the pressure chambers 26. Common ink channels 25 are provided on both sides of the pressure chambers 26. The head substrate 28 is formed through semiconductor processes. A diaphragm 40 is provided so as to cover the pressure chambers 26 in the head substrate 28. The diaphragm 40 is formed for example from an electrically conductive film of Cr or the like, and fulfills the function of a common electrode.

Piezoelectric layers 41 are provided on the diaphragm 40. These piezoelectric layers 41 are provided independently in correspondence with the respective pressure chambers 26. Individual electrode layers 42 are provided on the piezoelectric layers 41. The individual electrode layers 42 are also provided independently on the respective piezoelectric layers 41.

As shown in FIG. 14, each individual electrode layer 42 comprises an individual electrode 42-3 disposed in the position of the respective pressure chamber 26, a terminal 42-1 disposed at an edge of the head 23, and a connecting part 42-2 that connects the individual electrode 42-3 and the terminal 42-1 together. Connection to an external FPC 11 can thus be carried out using the terminals 42-1 disposed at the outer periphery of the head main body 23, and hence connection can be carried out without subjecting the piezoelectric layers 41 and the individual electrodes 42-3 of the pressure chambers 26 to a load. Damage to the driving parts can thus be prevented even if the piezoelectric layers 41 and the individual electrodes 42-3 are made thin down to the order of microns so that the nozzles can be formed to high density.

With this structure, as shown in FIGS. 15 and 16, the piezoelectric layers 41 exist even underneath the connecting parts 42-2 and the terminals 42-3, which are the wiring parts of the individual electrode layers 42, thus forming piezoelectric actuator laminated structures.

As shown by the oblique lines in FIG. 14, the diaphragm 40 is provided so as to avoid the wiring parts. Consequently, the common electrode is not present at the wiring parts, and hence the electrical capacitance of the wiring parts can be made to be zero. A driving lag of the piezoelectric bodies during driving can thus be prevented. Moreover, because the common electrode is not present at the wiring parts, unwanted movement of the piezoelectric bodies at the wiring parts can be prevented, and hence cross talk and breaking off of joining parts can be prevented.

To form this diaphragm 40, in FIG. 8(H), it is sufficient to carry out pattern formation for the diaphragm 40 as in FIG. 14. Such a diaphragm 40 can thus be realized easily.

[Fourth Embodiment]

Figure 17:
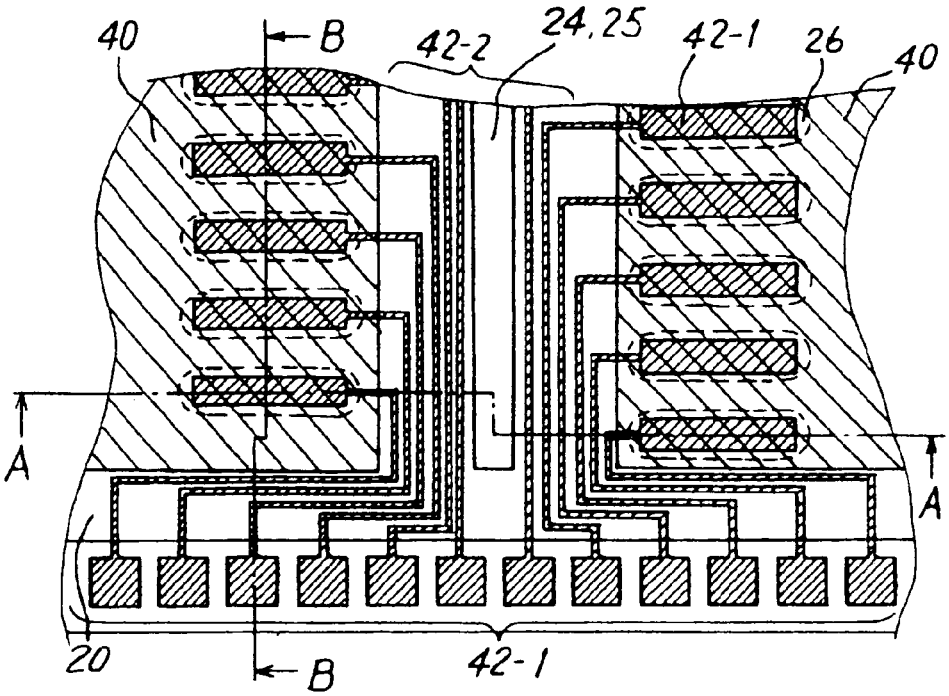
FIG. 17 is a top view of an ink jet head of a fourth embodiment of the present invention.
Figure 18:
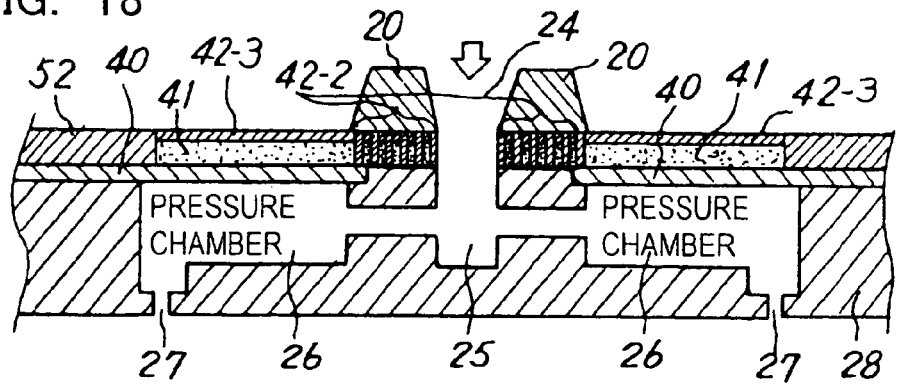
FIG. 18 is a sectional view along A—A in FIG. 17.
Figure 19:
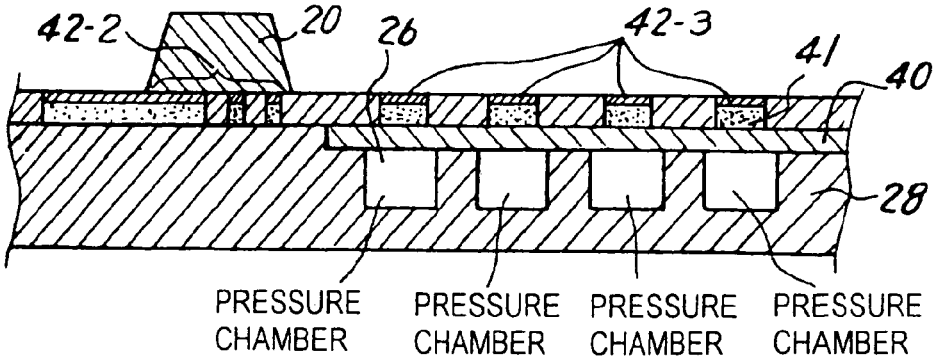
FIG. 19 is a sectional view along B—B in FIG. 17.

FIG. 17 is a top view of a head of a fourth embodiment of the present invention, FIG. 18 is a sectional view along A—A in FIG. 17, and FIG. 19 is a sectional view along B—B in FIG. 17. In the drawings for this embodiment, elements shown in FIGS. 3 to 5 are represented by the same reference numerals.

As shown in FIG. 18, formed in a head substrate 28 are a common ink channel 25, a large number of pressure chambers 26 that are connected to the common ink channel 25, and nozzles 27 that are connected to the pressure chambers 26. An ink supply hole 24 (see FIG. 2) is provided above the common ink channel 25. The head substrate 28 is formed through semiconductor processes. A diaphragm 40 is provided so as to cover the pressure chambers 26 in the head substrate 28.

The diaphragm 40 is formed for example from an electrically conductive film of Cr or the like, and fulfills the function of a common electrode. Piezoelectric layers 41 are provided on the diaphragm 40. These piezoelectric layers 41 are provided independently in correspondence with the respective pressure chambers 26. Individual electrode layers 42 are provided on the piezoelectric layers 41. The individual electrode layers 42 are also provided independently on the respective piezoelectric layers 41.

As shown in FIG. 17, each individual electrode layer 42 comprises an individual electrode 42-3 disposed in the position of the respective pressure chamber 26, a terminal 42-1 disposed at an edge of the head 23, and a connecting part 42-2 that connects the individual electrode 42-3 and the terminal 42-1 together. Connection to an external FPC 11 can thus be carried out using the terminals 42-1 disposed at the outer periphery of the head main body 23, and hence connection can be carried out without subjecting the piezoelectric layers 41 and the individual electrodes 42-3 of the pressure chambers 26 to a load. Damage to the driving parts can thus be prevented even if the piezoelectric layers 41 and the individual electrodes 42-3 are made thin down to the order of microns so that the nozzles can be formed to high density.

With this structure, as shown in FIGS. 18 and 19, the piezoelectric layers 41 exist even underneath the connecting parts 42-2 and the terminals 42-3, which are the wiring parts of the individual electrode layers 42, thus forming piezoelectric actuator laminated structures.

As shown by the oblique lines in FIG. 17, the diaphragm 40 is provided so as to avoid the wiring parts. Consequently, the common electrode is not present at the wiring parts, and hence the electrical capacitance of the wiring parts can be made to be zero. A driving lag of the piezoelectric bodies during driving can thus be prevented. Moreover, because the common electrode is not present at the wiring parts, unwanted movement of the piezoelectric bodies at the wiring parts can be prevented, and hence cross talk and breaking off of joining parts can be prevented.

To form this diaphragm 40, in FIG. 8(H), it is sufficient to carry out pattern formation for the diaphragm 40 as in FIG. 17. Such a diaphragm 40 can thus be realized easily.

[Fifth Embodiment]

Figure 20:
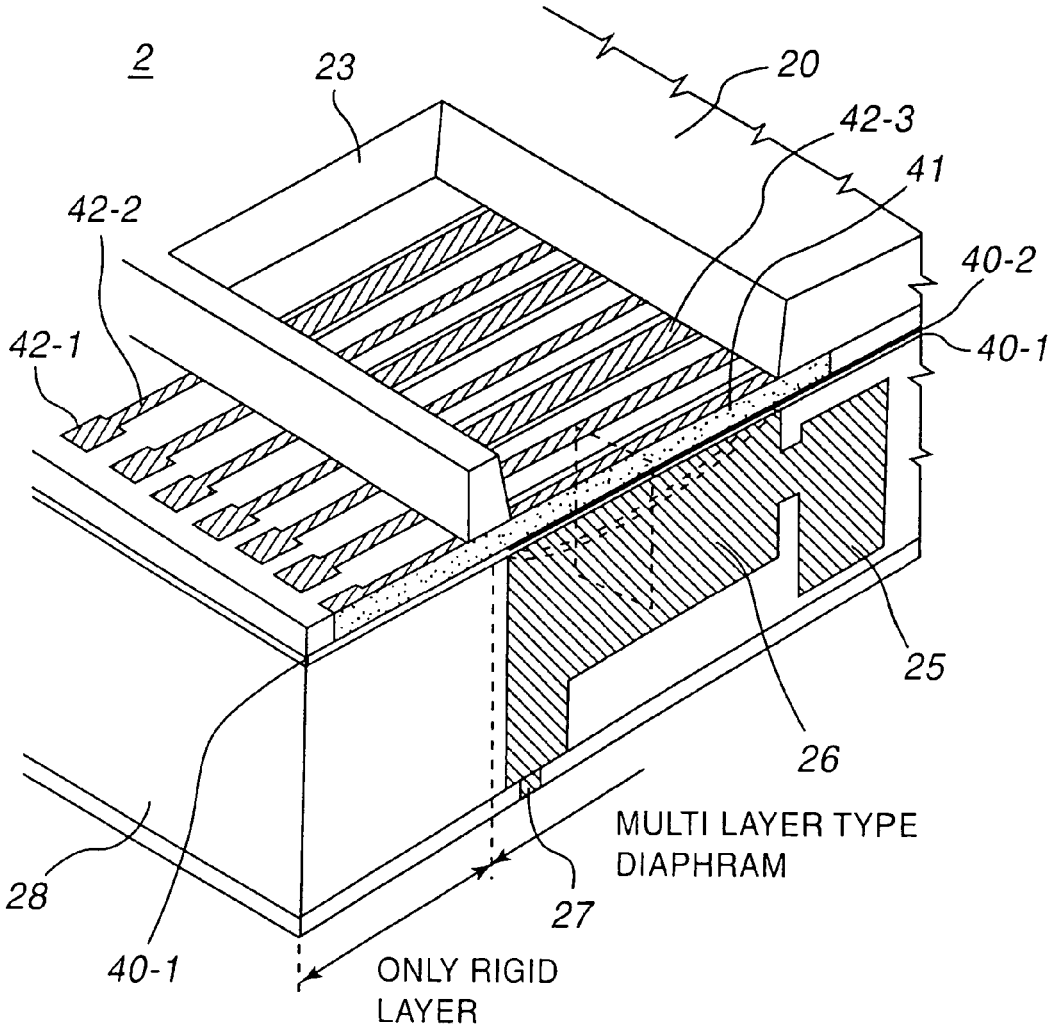
FIG. 20 is a drawing of the constitution of an ink jet head of a fifth embodiment of the present invention.
Figure 21:
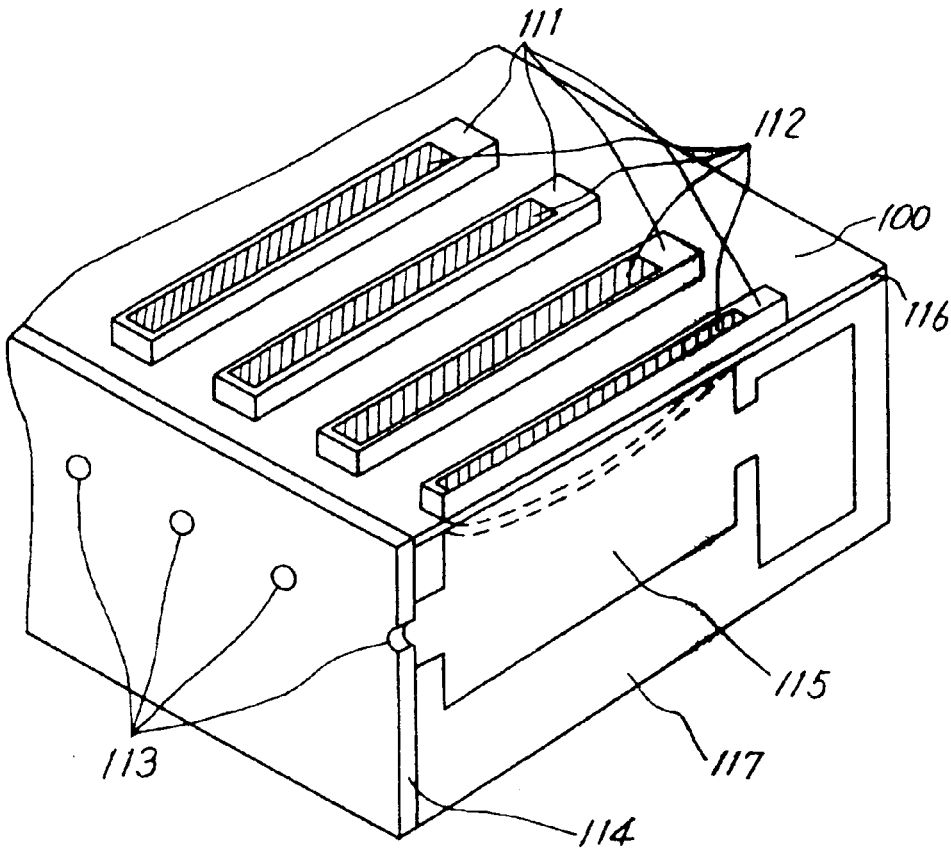
FIG. 21 PRIOR ART
FIG. 21 is a drawing of the constitution of a conventional multi-nozzle ink jet head.
Figure 22:
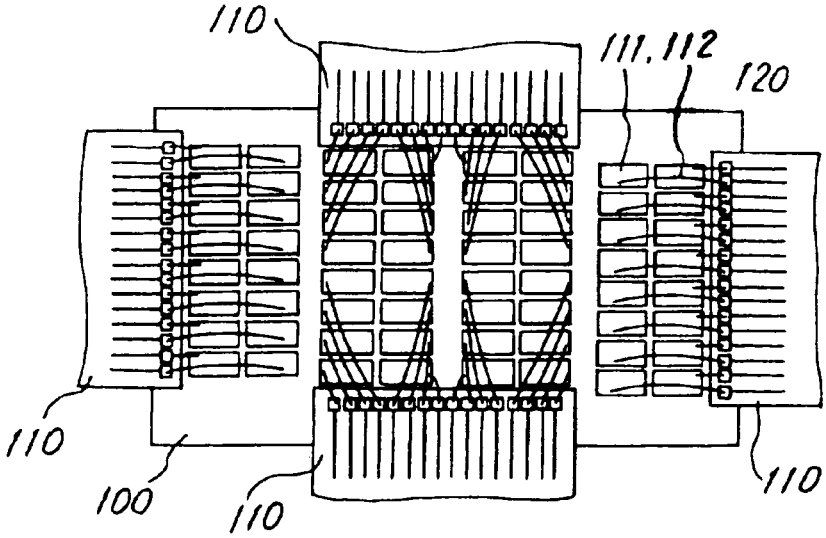
FIG. 22 PRIOR ART
FIG. 22 is a drawing of the system of connections for the conventional ink jet head.

FIG. 20 is a perspective view of a head of a fifth embodiment of the present invention, and corresponds to FIG. 6. In FIG. 20, elements the same as ones shown in FIG. 6 are represented by the same reference numerals. FIG. 20 shows a head using a laminate (electrode layer 40-2 plus rigid layer 40-1) as the diaphragm 40.

In the case of the head having this constitution, only the rigid layer 40-1, which is an insulator, is formed as the diaphragm 40 in the region of the led out wiring parts 42-2, 42-1 that are connected to the individual electrodes 42-3. That is, the electrode layer is formed in only the oblique line part in FIG. 10, FIG. 14 and FIG. 17. Consequently, the electrical capacitance of the wiring parts can be made to be zero, and unwanted vibration of the piezoelectric bodies can be prevented.

In the formation method of the first embodiment, in FIG. 8(H) patterning is carried out when forming Cr as the electrode layer 40-2, thus forming the Cr film in only the region of the driving parts, and then the rigid layer 40-1 (in the present embodiment, TiN; Young's modulus 600 GPa) is formed over the whole surface.

The present invention was described above through embodiments; however, various modifications are possible within the scope of the purport of the present invention, and these are not excluded from the scope of the present invention.

As described above, according to the present invention, by interposing a low-dielectric-constant layer or an insulating layer at the wiring parts of the thin-film elements in a high-density head, or by not forming the common electrode at these wiring parts, the electrical capacitance of the driving parts can be reduced, and hence a driving lag can be prevented. Moreover, expansion and contraction of the piezoelectric bodies at the wiring parts can be prevented, and hence breakage of the wiring and the occurrence of structural cross talk can be suppressed.

The invention claimed is:

1. A multi-nozzle ink jet head having a plurality of nozzles that eject ink, comprising:

a head substrate in which are formed said plurality of nozzles and a plurality of pressure chambers;

a diaphragm that functions as a common electrode and covers said plurality of pressure chambers;

piezoelectric body layers that are provided in correspondence with said pressure chambers on said diaphragm; and individual electrode layers that are provided on said piezoelectric body layers and have individual electrode parts corresponding to said pressure chambers and wiring parts of said individual electrode parts;

wherein said diaphragm has a laminated structure including a common electrode layer provided only in a region other than a region of said wiring parts, and a rigid layer.

2. The multi-nozzle ink jet head according to claim 1, wherein said rigid layer is provided in the regions of both said wiring parts and said individual electrode parts.

* * * * *